United States Patent [19]

Sadamatsu et al.

[11] 3,941,898

[45] Mar. 2, 1976

[54] DEVELOPING METHOD UTILIZING PULVERIZED, COLORED, CROSSLINKED, VINYLIC POLYMER RESIN AS TONER

[75] Inventors: Shigeru Sadamatsu; Toll Nozaki, both of Minami-ashigara, Japan

[73] Assignee: Fuji Xerox Co., Ltd., Tokyo, Japan

[22] Filed: Jan. 4, 1974

[21] Appl. No.: 430,615

[30] Foreign Application Priority Data

Jan. 16, 1973 Japan ..... 48-006612

[52] U.S. Cl. ..... 427/18; 252/62.1 P; 427/14; 427/20; 427/21

[51] Int. Cl.[2] ..... B05D 1/06; G03G 9/08

[58] Field of Search ..... 252/62.1, 62.1 P, 62.1 L; 117/17.5; 96/1 R, 15 D; 355/3 R, 30 D, 17; 427/14, 18, 21, 20

[56] References Cited

UNITED STATES PATENTS

| | | | |
|---|---|---|---|
| 3,502,582 | 3/1970 | Clemens et al. | 252/62.1 |
| 3,627,522 | 12/1971 | Jacknow et al. | 252/62.1 P |
| 3,723,114 | 3/1973 | Hagenbach et al. | 252/62.1 P |

*Primary Examiner*—Harry J. Gwinnell
*Assistant Examiner*—Stuart D. Frenkel
*Attorney, Agent, or Firm*—Gerald J. Ferguson, Jr.; Joseph J. Baker

[57] ABSTRACT

A method for developing a latent image bearing member comprising applying a developer thereto, the developer including a toner comprising a pulverized, colored vinylic polymer resin polymerized by adding to the monomer thereof a crosslinking agent 0.005 – 20% by weight of the monomer and a molecular weight control agent 0 – 20% by weight of the monomer.

13 Claims, No Drawings

DEVELOPING METHOD UTILIZING PULVERIZED, COLORED, CROSSLINKED, VINYLIC POLYMER RESIN AS TONER

BACKGROUND OF THE INVENTION

1. Field Of The Invention

This invention relates to a developing method and a developer composition and particularly to developing methods and developer compositions for use in electrophotography.

2. Discussion Of The Prior Art

Electrostatic formation of an image on the surface of a photoconductive material and development of the image are known.

For example, a fundamental xerographic process disclosed in U.S. Pat. No. 2,297,691 to C. F. Carlson comprises applying a uniform electrostatic charge on a photoconductive insulating layer, exposing the layer to a light image to thereby cause imagewise dissipation of the electrostatic charge on the layer and thus form an electrostatic latent image, depositing a very finely divided electroscopic material called toner, onto the obtained electrostatic latent image thereby obtaining a toner image corresponding to the latent image, transferring the toner image onto a surface of an image support material such as paper and permanently fixing the transferred image to the image support material by heating means, for example. In the above process, the formation of the electrostatic latent image can be alternatively effected by direct image formation by imagewise electrostatic charging the photoconductive insulating layer. Also, the transfer of the toner image can be dispensed with by directly fixing the image on the photoconductive insulating layer. Furthermore, the thermal fixing can be replaced by other appropriate fixing methods such as utilizing a solvent or a covering.

With respect to the application of the electroscopic powder to the electrostatic latent image, various processes have been proposed, one of which is the so-called cascade developing process disclosed in U.S. Pat. No. 2,618,552 to E. N. Wise. In this process, a developing material consisting of a finely divided toner powder and another powder (called the carrier) of relatively large particle size, the surface of which is electrostatically coated, is conveyed in a conveyor and is cascaded down along a surface bearing the electrostatic latent image. The carrier powder is selected to electrostatically charge the toner powder to a desirable polarity by means of friction charging. As the developing material is cascaded over the electrostatic latent image, the toner powder is attracted electrostatically to the charged areas of the electrostatic latent image and remains fixed thereon while no such adhesion takes place on the uncharged or background areas of the image. A major portion of the toner deposited on the background areas is removed by carrier powder falling thereover because the electrostatic attractive force between the toner powder and carrier powder is stronger than that between the toner powder and the background areas from which electrostatic charge has been dissipated. The carrier powder and excessive toner powder are recycled for repeated use in the process. The above-mentioned process is particularly preferable for developing line images.

Another example of a process for developing an electrostatic latent image is the magnetic brush process disclosed in U.S. Pat. No. 2,874,063. In this process, a developing material containing toner powder and magnetic carrier powder is supported by a magnet and arranged in the shape of a brush which is brought into contact with a surface bearing the electrostatic latent image whereby the toner powder is attracted, by means of an electrostatic attractive force, to the latent image from the magnetic brush.

Another example of a process for developing an electrostatic latent image is the so-called powder cloud developing process disclosed in U.S. Pat. No. 2,221,776 to C. F. Carlson in which developing material consisting of a charged toner powder floating in a gaseous fluid is flowed in the vicinity of a surface bearing the electrostatic latent image whereby the toner is attracted, by means of an electrostatic attractive force, to the latent image from the fluid. This process is particularly preferable for developing an image with continuous tone.

Another example of a process for developing an electrostatic latent image is the liquid developing process disclosed in U.S. Pat. No. 2,899,355 in which a developing material consisting of charged toner powder dispersed in a liquid is flowed over a surface bearing the electrostatic latent image whereby the toner is attracted by means of an electrostatic attractive force to the latent image from the liquid.

Another example of a process for developing an electrostatic latent image is the C-shell developing process disclosed in U.S. Pat. No. 3,503,776. In this process, the toner powder and carrier powder are maintained in continued contact with the drum surface. This process is characterized by low cost and is effective for removing unnecessary toner powder deposited on the background areas.

Another example of a process for developing an electrostatic latent image is the fur brush developing process disclosed in U.S. Pat. No. 2,902,974 in which a fur brush of, for example, cylindrical shape which is dusted with toner powder is rotated in contact with an electrostatic latent image to develop the latent image.

Furthermore, another example of a process for developing an electrostatic latent image is the touch-down developing process disclosed in U.S. Pat. No. 3,166,432 which is employed in certain areas.

Althrough the above-mentioned developing processes are commercially utilized at present, the xerographic developing process most widely employed commercially is the cascade developing process, the use of which in a universal business copying machine is described in U.S. Pat. No. 3,099,943. The cascade development is generally achieved in commercial devices by cascading a developing mixture down the surface of a drum having a horizontal axis and bearing an electrostatic latent. The developing mixture or developing material is conveyed by means of an endless belt conveyor from a trough or a container to a position above the drum, from which the developing material is cascaded down along the surface of the drum and returned to the container after development of the electrostatic latent image. A small amount of toner is synchronously added to the developing mixture in order to replenish the consumption of the toner by development. The toner image thus formed on the drum is ordinarily transferred onto a sheet of paper and then fixed thereon, for example, by fusion with an appropriate device. After the transfer, the surface of the drum is cleaned for repeated use. This developing process is repeated for each reproduction produced in the copying machine, ordinarily several ten thousand times within the effective lifetime of the developing material.

As is obvious from the foregoing explanation, the toner powder is subjected to vigorous mechanical abrasion in any developing process, which eventually leads to pulverizing of the toner powder or smearing of the carrier powder by adhesion of the toner thereon. This effect can be lessened when the toner powder contains a tenacious resin component of high molecular weight capable of withstanding shearing and impact force. Unfortunately, however, most tenacious high-molecular resins are not suitable for use in high-speed automatic copying machines, principally because of the difficulty in rapid fusion of the toner image in the heating step thereof.

On the other hand, the use of a larger heater with an elevated capacity for rapid fusion of toner with a high melting point makes it difficult to prevent the support paper from scorching and to dissipate efficiently the heat generated by the heater. Occasionally the support paper burns after having passed the heater. Thus, the prevention of burning or scorching of the paper generally necessitates additional equipment such as an expensive and complicated cooling device in order to dissipate the large amount of heat generated by the heater. Also, incomplete removal of the generated heat not only gives an unpleasant feeling to the operator of the machine but also damages mechanical components susceptile to heat. Furthermore, the relatively high running cost of such heater and cooling equipment as well as the considerable space occupied thereby frequently cannot be justified by higher machine speed, which results from the use of the heater and cooling equipment.

The above-mentioned drawbacks can be resolved to a certain extent by the use of a heat roll fuser, which fixes the toner image by pressing it while heating it. This fuser provides a satisfactorily fixed image even at a lower temperature of the heating element than that obtainable with radiant heat. Thus, an increase of operating speed is effected to a certain extend, but the above-mentioned problems are still unavoidable if the machine speed has to be further increased.

On the other hand, though the use of a resin of lower molecular weight which can be easily fused and fixed at a relatively low temperature seems to resolve the fixing problems, the use of a heater with increased heating capacity or of a heat roll fuser is still indispensable for a significant increase of operating speed. A heat roll fuser is preferred since the use of a heater of elevated heating capacity will naturally encounter the above-mentioned problems. In this case, the toner consisting of a resin of low molecular weight adheres, at the fusion thereof, not only to the paper but also to the heat roll, leading eventually to severe staining of the fuser lubricator which is a cloth provided to clean the heat roll and finally to staining of the paper itself. Furthermore, most resins of low molecular weight tend to decompose when fused in a high-speed copying apparatus. Further, they tend to form a sticky image which can be offset from one paper sheet to an adjacent sheet. Furthermore, such resins of low molecular weight tend to form a thick film over the photoconductive material which is repeatedly used, and this film deteriorates the toner images thus increasing the down time of the apparatus. Furthermore, it is extremely difficult or rather nearly impossible to pulverize such resins of low molecular weight in a conventional grinding apparatus.

The toner material must be electrostatically charged with a proper polarity when brought into friction contact with the surface of the carrier material in a cascade or touch-down developing device. The charge characteristics by friction and flow of most toner materials are affected by humidity in the air. For example, certain toners show fluctuation in the frictional electricity thereof in accordance with the relative humidity and thus are not particularly usable in a xerographic apparatus. Consequently, a toner with a constant charging characteristic by friction is particularly desirable for automated apparatus.

Another factor affecting the stability of charging characteristics of toner is the tendency thereof to collide with the surface of the carrier, which is observed in certain toner materials. In the course of multiple usage of the developing material in an automatic developing machine, the numerous collisions taking place between the carrier and toner in the device cause the toner powder sticking on the carrier surface to form a film deposit on the surface. Such a gradually increasing deposition of the toner alters the charging characteristics of the carrier, reducing the ability thereof to hold toner powder thereon and eventually deteriorating the image quality of the obtained copy.

The abrasive nature of most carrier and toner materials accelerates other deterioration because of the frictional contact between the toner, carrier and the surface of a xerographic layer, which requires frequent replacement of the xerographic layer which is costly and time consuming.

Furthermore, images obtained by a xerographic process not only have to have a satisfactorily high line image contrast but also must be capable of reproducing a solid black area. It is known, however, that an improvement in either line image contrast or solid area reproduction will generally result in deterioration of the other. More specifically, the application of a larger amount of toner onto an electrostatic latent image in order to increase the image density will generally give rise to undesirable toner deposition on also the background areas.

SUMMARY OF THE INVENTION

The toner powder of the prior art is associated with the above-mentioned drawbacks, and a principal object of the present invention is to provide an improved developing method and developing composition which is free from such drawbacks.

Another object of the present invention is to provide an improved developing method and developer composition which is capable of stably functioning even under fusing conditions in a high-speed copying machine.

Still another object of the present invention is to provide an improved developing method and developer composition capable of being fused and fixed at a relative high speed with a relatively limited amount of thermal energy.

Still another object of the present invention is to provide an improved developing method and developer composition which can be used in combination with a heat roll without adhesion thereto or smearing the copy paper or lubricator for the roll.

Still another object of the present invention is to provide an improved developing method and developer composition capable of withstanding mechanical impact.

Still another object of the present invention is to provide an improved developing method and developer composition having stable frictional electricity characteristics even under varying humidity conditions.

Still another object of the present invention is to provide an improved developing method and developer composition which has a reduced tendency to smear devices or apparatus used in combination therewith.

Still another object of the present invention is to provide an improved developing method and developer composition which has a reduced tendency of forming aggregate particles.

Still another object of the present invention is to provide an improved developing method and developer composition which can be easily removed by carrier from the background areas of an electrostatic latent image.

Still another object of the present invention is to provide an improved developing method and developer composition which can be easily cleaned from a surface bearing an electrostatic latent image.

Still another object of the present invention is to provide an improved developing method and developer composition capable of lessening mechanical abrasion of a surface bearing an electrostatic latent image.

Still another object of the present invention is to provide an improved developing method and developer composition provided with physical and mechanical properties superior to those of prior art developers.

Other objects and advantages of this invention will become apparent upon reading the appended claims in conjunction with the following detailed description.

DETAILED DESCRIPTION OF PREFERRED EMBODIMENTS OF THE INVENTION

The above-mentioned objects can be achieved by preparing a resin by polymerization in the presence of a crosslinking agent and a material capable of controlling molecular weight to obtain a crosslinked polymer of a controlled molecular weight, mixing coloring materials to the thus obtained polymer and pulverizing the obtained mixture.

For the polymerization, ordinarily available reactors for polymerization can satisfactorily be employed. Though various processes such as block polymerization, suspension polymerization, emulsion polymerization or solution polymerization can be employed for this purpose, block polymerization or suspension polymerization is preferred in consideration of the mixing of the resulting polymer with the coloring materials.

The crosslinking agent to be employed in the present invention may be selected from the group of compounds provided with at least two polymerizable double bonds, for example, aromatic divinyl compounds such as divinylbenzene, divinylnaphthalene or derivatives thereof; diethylenecarboxylate esters such as diethyleneglycol methacrylate, diethyleneglycol acrylate, triethyleneglycol methacrylate, trimethylolpropan trimethacrylate, allyl methacrylate, t-butylaminoethyl methacrylate, tetraethyleneglycol dimethacrylate or 1,3-butanediol dimethacrylate; any other divinyl compounds such as divinyl sulfide or divinyl sulfone compounds provided with three or more vinyl radicals; or mixtures of the foregoing compounds. The crosslinking agent is added in an amount from 0.005 to 20% with respect to the total weight of the monomer. A range of 0.5 to 10% is particularly preferable, however, as a larger amount tends to result in the formation of an insoluble and infusible resin whereas a smaller amount does not exert a sufficient effect.

An addition of a crosslinking agent generally provides a polymer with an elevated molecular weight which becomes insoluble and infusible because of the development of a three-dimensional network if the added amount is excessively increased. The addition of a material for controlling molecular weight for preventing such phenomenon is already known. This material is generally called a chain transfer agent and captures molecular chains in the course of growth to arrest the increase in molecular weight and stimulate the captured active center to start another chain reaction.

The species and amount of material for molecular weight control are selected according to the desired degree of molecular weight control. Examples of such materials which are effective even in a very small amount are mercaptanes such as laurylmercaptane, phenylmercaptane, butylmercaptane, dodecylmercaptane; or halogenated carbons such as carbon tetrachloride or carbon tetrabromide. Also, examples of materials which become effective when used in a much larger amount such as solvents for the vinyl monomer are substituted aromatic compounds such as toluene or isopropylbenzene; or substituted fatty acids such as trichloroacetic acid or tribromoacetic acid. Also, examples of materials which can be added as a monomer to be incorporated in the resulting polymer and simultaneously effect molecular weight control are ethylenic unsaturated monoolefins with radicals such as propylene or isobutylene; allyl compounds such as allyl benzene, allyl acetate or allylidene chloride. Any member of the above-mentioned compounds can be employed for the purpose of the present invention, but those which can be used as solvents, as described above, are excluded from the scope of the present invention. In the present invention, the material for molecular weight control is added in an amount ranging from 0 to 20% with respect to the principal monomer for producing the polymer.

The principal polymer, which is a vinylic polymer constituting the major part of the toner is a homopolymer or copolymer of two or more vinylic monomers. Representative examples of monomers for forming the vinylic polymer are styrene, p-chlorostyrene, vinylnaphthalene, ethylenic unsaturated monoolefines such as ethylene, propylene, butylene or isobutylene; vinyl esters such as vinyl chloride, vinyl bromide, vinyl fluoride, vinyl butyrate, vinyl formate, or vinyl capronate; ethylenic monocarboxylic acids or esters thereof such as methyl acrylate, dodecyl acrylate, n-octyl acrylate, 2-chloroethyl acrylate, phenyl acrylate, methyl $\alpha$-chloroacrylate, methyl methacrylate, ethyl methacrylate or butyl methacrylate; substituted ethylenic monocarboxylic acids such as acrylonitrile, methacrylonitrile or acrylamide; ethylenic dicarboxylic acids and substituted derivatives thereof such as dimethyl maleate, diethyl maleate or dibutyl maleate; vinyl ketones such as vinylmethylketone, vinylhexylketone or methylisopropylphenyl ketone; vinyl ethers such as vinylmethyl ether, vinylisobutyl ether or vinylethyl ether; vinylidene halides such as vinylidene chloride or vinylidene chlorofluoride; or N-vinyl compounds such as N-vinylpyrol, N-vinyl carbazol, N-vinyl indole or N-vinyl pyrrolidone. The polymer used in the present invention may be produced by additional polymerization of at least a member of the above-mentioned monomers and at least one of the aforementioned crosslinking agents, wherein the additional polymerization includes already known polymerization processes such as radical, anionic and cationic polymerization.

The vinylic resin adapted for use as toner generally has an average molecular weight within a range from about 3,000 to 500,000.

Monomer or monomers employed for producing the principal polymer are selected so as to optimize the electric characteristics, image rendition, image etc., of the polymer. The polymer used as the toner can also be produced by copolymerization of two or more monomers. Moreover, the vinylic polymer according to the present invention can be mixed with other thermoplastic resins. Representative examples of non-vinylic resins employable for this purpose are resin-modified formaldehyde resins, oil-modified epozy resins, polyurethane resins, cellulose resins, polyether resins, and the mixtures thereof. Furthermore, a plasticizer can be added to the polymer.

Any suitable dye or pigment is added as a coloring material to the toner powder. Various coloring materials are already known, such as carbon black, nigrosin dyes, aniline blue, alcoyl blue, chrome yellow, ultramarine blue, dupont oil red, monoline yellow, methylene blue chloride, phthalocyanine blue, malachite green oxalate, lamp black, rose bengale and the mixtures thereof. The dye or pigment should be present in a sufficient amount in the toner so as to give thereto an intense color capable of forming a clearly visible image on paper. Consequently, when a xerographic copy of a document is required, the toner can be prepared with a black pigment such as carbon black or black dye such as amaplast black dye. Such a pigment is preferably added in an amount from about 3 to 20 wt. % of the total amount of colored toner. In the case of a dye, the amount can be considerably reduced.

The developer composition of the present invention can be prepared by any conventional process of mixing and pulverizing toner material. For example, the components are mixed in a desired composition and crushed to effect a thorough blending, and the obtained mixture is finely pulverized. Another process for forming the toner powder comprises blending the coloring material, resin and a solvent and spray drying the thus obtained mixture.

For use in the cascade, magnetic brush or C-shell developing processes, the developer composition of the present invention should have an average particle size not exceeding about 30 microns and preferably within a range from about 4 to 20 microns for an optimum result. In the powder cloud developing process, the average particle size is preferably slightly smaller than 1 micron.

The use of coated or uncoated carriers is already known in the cascade, magnetic brush or C-shell developing processes, and the carrier can be formed of any suitable material so long as the carrier particles assume an electrostatic charge of a polarity opposite to that of the charge on the toner powder when the carrier particles are kept in close contact with the toner powder.

The developer composition according to the present invention is utilized for developing an electrostatic latent image on any suitable surface, including a conventional photoconductive surface bearing a latent image.

The following examples indicate various embodiments of processes for producing the developer composition of the present invention and of processes for developing an electrostatic latent image with said composition, but the present invention is by no means limited to these embodiments.

REFERENCE EXAMPLE 84 parts (hereinafter expressed by weight) of water containing 0.66 wt. % polyvinyl alcohol (GH-20 supplied by Nihon Gosei Kagaku Co., Ltd.) was placed in a 30 l. polymerization reactor equipped with an agitator, 27.3 parts of styrene, 14.7 parts of n-butyl methacrylate and 1 part of azobis-isobutyronitrile were then added and subjected to polymerization for 8 hours at 90°C under agitation. After completion of polymerization, the obtained suspension was cooled, then dehydrated by centrifuging, washed with water and dried to obtain a bead polymer.

1.8 parts of the bead polymer, 0.2 part of carbon black (Black Pearl) and 0.2 part of polyvinyl butyral were blended well, pressed into an intensive mixer under a hydraulic pressure of 7 kg/cm² and a compressor pressure of 5.0 kg/cm² and blended for 10 minutes at 80°C. The mixture was taken out from the mixer, cooled, crushed, then subjected to preliminary pulverizing to several hundred microns in a free mill and finally pulverized finely in a jetmizer at a feed rate of 1.6 kg/hr. and under an air pressure 6.3 kg/cm² to obtain a fine powder with an average particle size of 12 microns which was utilized as the toner.

The toner thus obtained was used for making copies of a standard test pattern on a Xerox 720 copier. The temperature of the heat roll used for fusing was measured from the exterior by means of a surface thermometer. The copies thus obtained were subjected to a peel test on a coat strength tester with two reciprocating strokes under a load of 200, 500 or 700 gms, and the fixing rate was determined from the ratio of image density before and after the test. A fixing rate of 100% under a load of 700 g. can be considered as a complete fixing. Under this condition, the minimum fixing temperature of the heat roll was found to be 190°C. At a higher temperature, the toner adheres to the heat roll and smears the copied image similarly as in a prolonged operation, and the easiness of adhesion can be determined by examining the number of copies at which the smear appears at a further higher temperture. With the toner of this example, the smear starts to appear at approximately the 5,000th copy and becomes marked at approximately the 8,000th copy at a heat roll temperature of 210°C., indicating significant adhesion of the toner on the heat roll.

EXAMPLE 1

84 parts (hereinafter by weight) of water containing 0.66 wt. % polyvinyl alcohol (GH-20 supplied by Nihon Gosei Kagaku Co., Ltd.) was placed in a 30 l. polymerization reactor equipped with an agitator, then 27.3 parts of sytrene containing 1.4 wt.% (with respect to the styrene) ethyleneglycol dimethacrylate and 1.3 % lauryl mercaptane and 1 part of azobisisobutyronitrile were then added and subjected to polymerization for 8 hours at 90°C. After completion of polymerization, the obtained suspension was cooled, dehydrated by centrifuging, washed with water and dried to obtain a bead polymer.

1.8 parts of thus obtained bead polymer, 0.2 part of carbon black (Black Pearl Swell) and 0.2 part of polyvinyl butyral were well mixed, then pressed into an intensive mixer under a hydraulic pressure of 7 kg/cm² and a compressor pressure of 5.0 kg/cm², and blended for 10 minutes at a temperature of 80°C. The mixture thus obtained was taken out from the mixer, cooled, then crushed, successively subjected to preliminary pulverizing to an average particle size of several hundred microns in a free mill and finally finely pulverized in a jetmizer at a feed rate of 1.6 kg/hr and under an air pressure of 6.3 kg/cm² to obtain a fine powder with an average particle size of 13 microns which was used as the toner. The toner thus obtained was utilized for making copies in a Xerox 720 copier in the same manner as in the reference example. With this toner, it was found that fixing of the image became possible from 140°C., that the smear on the heat roll was scarce even at 210°C., and that the copied image was not smeared even after 10,000 copies.

EXAMPLE 2

The process of Example 1 was repeated with 0.1% ethylene glycol and 0% lauryl mercaptane to obtain a bead polymer, which was employed for preparing toner in the same manner as in Example 1. Copying on a Xerox 720 copier as in the Reference Example verified that fixing was possible from 170°C., that smear on the heat roll was scarce even at 230°C., and that smear on the copied image did not appear even after 15,000 copies.

EXAMPLE 3

The process of Example 1 was repeated with styrene containing 13% ethylene glycol and 14% lauryl mercaptane to obtain a bead polymer, which was used for making toner in the same manner as in Example 1. Copying on a Xerox 720 copier as in the Reference Example verified that fixing was possible from 120°C., that smear on the heat roll was scarce even at 200°C., and that smear on the copied image did not appear even after 15,000 copies.

EXAMPLE 4

84 parts of water containing 0.66 wt.% polyvinyl alcohol (GH-20 supplied by Nihon Gosei Kagaku Co., Ltd.) was placed in a 30 l. polymerization reactor equipped with an agitator. 273 parts of styrene containing 3 wt.% carbon tetrachloride, 14.7 parts of normal butyl methacrylate and 2 parts of azobisisobutyronitrile were then added and subjected to polymerization for 8 hours at 90°C. Toner was prepared in the same manner as in Example 1. Copying on a Xerox 720 copier as in the Reference Example verified that fixing of the image became possible from 140°C., that smear on the heat roll was scarce even at 200°C., and that smear on the copied image did not appear even after 10,000 copies.

EXAMPLE 5

65 parts of styrene containing 2% ethylene glycol dimethacrylate and 1.5% lauryl mercaptane, 35 parts of n-butyl methacrylate and 1 part of azobisisobutyronitrile were placed in a 5 l. glass polymerization reactor with detachable agitator and subjected to polymerization under agitation at 90°C., until the system became viscous. Successively, the agitator was removed and the polymerization was continued for 10 hours at 130°C. Then the reaction mixture was cooled with the glass reactor and taken out by breaking the glass reactor. The polymer thus obtained was crushed, remaining monomer was removed in a vacuum drier and the polymer was blended according to the process of Example 1 to obtain a toner. Copying with the toner on a Xerox 720 copier verified that fixing of the image became possible from 150°C., that the smear on the heat roll was scarce even at 230°C., and that smear on the copied image did not appear even after 20,000 copies.

EXAMPLE 6

80 parts of water containing 0.90% sodium polyacrylate was placed in a 30 l. polymerization reactor, equipped with an agitator and then 25 parts of methyl methacrylate containing 1 wt.% (with respect to the methyl methacrylate) ethyleneglycol dimethacrylate and 1.2% lauryl mercaptane, 5 parts of butyl acrylate and 1 part of azobisisobutyronitrile and subjected to polymerization under agitation for 8 hours at 70°C. After the completion of polymerization, the suspension was cooled, dehydrated by centrifuging, washed and dried to obtain a bead polymer.

The bead polymer was blended in the same manner as in Example 1 to obtain a fine powder with an average particle size of 15 microns which was used as a toner. Copying with the toner on a Xerox 720 copier as in the Reference Example verified that the copied image appeared as a negative, that fixing of the image became possible from 190°C., that smear on the heat roll was scarce even at 260°C., and that smear on the copied image did not appear even after 10,000 copies.

Numerous modifications of the invention will become apparent to one of ordinary skill in the art upon reading the foregoing disclosure. During such a reading, it will be evident that this invention provides a unique developing method and developer composition for use therewith for accomplishing the objects and advantages hereinstated.

What is claimed is:

1. A method for developing a latent electrostatic image bearing member comprising forming a latent electrostatic image on said member and applying a developer thereto, said developer including at least a toner where said toner is affected by said latent image to effect development thereof, said toner comprising a pulverized, colored, crosslinked, vinylic polymer resin obtained by (a) polymerizing the monomer thereof in the presence of a crosslinking agent 0.005 – 20% by weight of the monomer, said crosslinking agent being selected from the group consisting of aromatic divinyl compounds, diethylenecarboxylate esters, divinyl sulfide, divinyl solfone, and mixtures thereof and a molecular weight control agent 0 – 20% by weight of the monomer, said monomer being non-soluble in said molecular weight control agent, (b) mixing at least one coloring material with the thus obtained resin and (c) pulverizing the obtained mixture.

2. A method as in claim 1 where said vinylic polymer resin is a homopolymer or a copolymer of at least two vinylic monomers.

3. A method as in claim 2 where said monomer is selected from the group consisting of styrene, p-chlorosytrene, vinyl-naphthalene, ethylenic unsaturated monoolefins, vinyl esters, ethylenic monocarboxylic acids and esters thereof, substituted ethylenic monocarboxylic acids, ethylenic dicarboxylic acids and substituted derivatives thereof, vinyl ketones, vinyl esters, vinylidene halides, and N-vinyl compounds.

4. A method as in claim 1 where the average molecular weight of said vinylic polymer resin is about 3,000 to 500,000.

5. A method as in claim 1 where the amount of said crosslinking agent is 0.5 to 10% by weight of the monomer.

6. A method as in claim 1 where said molecular weight control agent is selected from the group consisting of mercaptanes, halogenated carbons, ethylenic unsaturated monolefins and allyl compounds.

7. A method as in claim 1 where the vinylic polymer resin is colored by a coloring material selected from the group consisting of dyes and pigments, the coloring material being no more than 20% by weight of the colored resin.

8. A method as in claim 9 where the coloring material is a pigment, the pigment being at least 3% by weight of the colored resin.

9. A method as in claim 1 where the process of said application of said developer to the electrostatic latent image bearing member is by powder cloud developing and where the average particle size of said pulverized, colored vinylic polymer resin is slightly less than one micron.

10. A method as in claim 1 where the process of said application of said developer to the electrostatic latent image bearing member comprises the cascade developing process, the average particle size of said pulverized, colored, crosslinked vinylic polymer resin being from 4 – 20 microns.

11. A method as in claim 1 where the process of said application of said developer to the electrostatic latent image member comprises the magnetic brush developing process, the average particle size of said pulverized, colored, crosslinked vinylic polymer resin being from 4 – 20 microns.

12. A method as in claim 1 where the process of said application of said developer to the electrostatic latent image bearing member comprises the C-shell developing process, the average particle size of said pulverized, colored, vinylic polymer resin being from 4 – 20 microns.

13. A method as in claim 1 including the steps of transferring the developed toner image to a copy sheet and fixing the transferred toner image onto a copy sheet by feeding the copy sheet by a heat fixing roller where the heated roller contacts the transferred toner image to thereby fix it onto a copy sheet.

* * * * *

Notice of Adverse Decision in Interference

In Interference No. 99,884, involving Patent No. 3,941,898, S. Sadamatsu and T. Nozaki, DEVELOPING METHOD UTILIZING PULVERIZED, COLORED, CROSSLINKED, VINYLIC POLYMER RESIN AS TONER, final judgment adverse to the patentees was rendered Dec. 17, 1981, as to claims 1–3, 5, 7, 8, 11 & 13.

[*Official Gazette April 6, 1982.*]